US005549232A

United States Patent [19]

Scholfield

[11] Patent Number: 5,549,232

[45] Date of Patent: Aug. 27, 1996

[54] PAPER ROLL NOTE PAD

[76] Inventor: Richard P. Scholfield, 4608 Eastlake Cir., Sarasota, Fla. 34232

[21] Appl. No.: 201,460

[22] Filed: Feb. 24, 1994

[51] Int. Cl.[6] ..... B42D 19/00; B26F 3/02; B65H 16/02

[52] U.S. Cl. ..... 225/46; 225/77; 242/595; 281/11

[58] Field of Search ..... 225/39, 42, 46, 225/76, 77; 242/595; 281/11, 12, 13; D19/78, 84, 89, 90, 91, 92

[56] References Cited

U.S. PATENT DOCUMENTS

| | | | |
|---|---|---|---|
| D. 91,233 | 12/1933 | Connaway | D19/89 X |
| D. 118,936 | 2/1940 | Guild | D19/89 X |
| D. 138,852 | 9/1944 | King | D19/89 |
| D. 142,612 | 10/1945 | Bletzinger | D19/89 X |
| D. 154,294 | 6/1949 | Marlow | D19/89 X |
| D. 181,579 | 12/1957 | Dodge | D19/89 X |
| D. 196,349 | 9/1963 | Smith | D19/84 X |
| D. 202,459 | 9/1965 | Aro | D19/90 |
| D. 354,312 | 1/1995 | Pohlman | D19/90 |
| D. 361,091 | 8/1995 | Scholfield | D19/78 |
| 1,173,795 | 2/1916 | Goldberger et al. | 225/77 X |
| 1,539,994 | 6/1925 | Cooper | 281/11 |
| 1,713,857 | 5/1929 | Rapp | 225/42 |
| 2,047,255 | 7/1936 | Colburn | 225/42 X |
| 2,987,864 | 6/1961 | Miller | 225/77 X |
| 3,273,846 | 9/1966 | De Mare | 248/231.7 |
| 4,327,875 | 5/1982 | Lightfoot | 242/595 X |
| 4,877,197 | 10/1989 | Nelson | 242/395 |

FOREIGN PATENT DOCUMENTS

| | | | |
|---|---|---|---|
| 2343679 | 10/1977 | France | 225/77 |
| 3095055 | 4/1991 | Japan | 242/595 |
| 231399 | 4/1925 | United Kingdom | 225/77 |
| 2011854 | 7/1979 | United Kingdom | 225/42 |

*Primary Examiner*—Rinaldi I. Rada
*Assistant Examiner*—Clark F. Dexter
*Attorney, Agent, or Firm*—Cushman Darby & Cushman, L.L.P.

[57] ABSTRACT

A roll paper note taking device that is capable of effectively utilizing roll paper in either a horizontal or vertical fashion because the paper roll housing defines a seat for the paper roll so that the paper is tensioned irrespective of the remaining paper supply. The device also employs a rotatable bin for holding writing utensils that is capable of being oriented either vertically or horizontally.

23 Claims, 7 Drawing Sheets

PAPER ROLL NOTE PAD

BACKGROUND OF THE INVENTION

1. Field of the Invention

The present invention relates to an apparatus for dispensing paper from a roll and more particularly a device for dispensing paper which is suitable for taking pen and pencil messages together with an integral sharp edge against which the paper can be cleanly torn off at any desired length, and a device designed to be used in either a horizontal or vertical position, all as described in more detail in the summary below.

2. Description of the Related Art

It has long been recognized that it is necessary to memorialize ideas and leave messages lest they be forgotten. Paper is the preferred medium for memos and messages since it is both portable and permanent. Thus, efforts to develop a versatile paper dispensing device with an ample supply of paper have continued over the years.

To that end, paper roll devices have been proposed that utilize a spindle, roller guide, and suitable tearing knife. In his 1923 patent U.S. Pat. No. 1,539,994, Doctor L. Cooper discloses a paper roll mounted on a dowel high above a message note taking area. Ten years later, Cass Connaway patented a paper roll note taking device complete with spindle, roller guide, and calendar in his U.S. Pat. No. Des. 91,233.

Paper roll devices having ornamental features have also been patented. Such patented devices include the combined memo paper roll and pencil holder of U.S. Pat. No. Des. 181,579 and U.S. Pat. No. Des. 142,612 for a stamped metal paper roll holder by Bletzinger.

SUMMARY OF THE INVENTION

Despite prior developments in this art, as noted above, there remains a need for a versatile device with an ample supply of paper, that is easy to load, and that maintains tension on the paper to control feed. It is therefore an object of this invention to provide an improved paper roll note taking device.

A concomitant object of the invention is to provide a quick and efficient way to permit the insertion of a new roll of paper.

It is yet a further object of the invention to provide a dispensing device that controls paper feed. In order to control feed, the inventive device provides a seat for the paper roll with which contact is maintained by gravity irrespective of the diminishing size of the roll as the roll is used. Also, a tortuous path is provided for the paper being dispensed. These features each insure constant moderate tension against rotation of the paper roll.

Roll retaining devices such as dowels, springs, rods, or clamping techniques pose an extra burden when changing rolls and are usually the cause of the unmanageable free flow of paper. The device of the invention advantageously omits such retaining devices. Thus, the invention not only allows the user to easily change or replace the paper rolls, but also maintain the desired tension.

The invention itself, however, both as to its construction and its method of operation, together with additional objects and advantages thereof, will be best understood from the description of specific embodiments when read in connection with the accompanying drawings.

DETAILED DESCRIPTION OF THE PRESENTLY PREFERRED EXEMPLARY EMBODIMENTS

Figure 1:
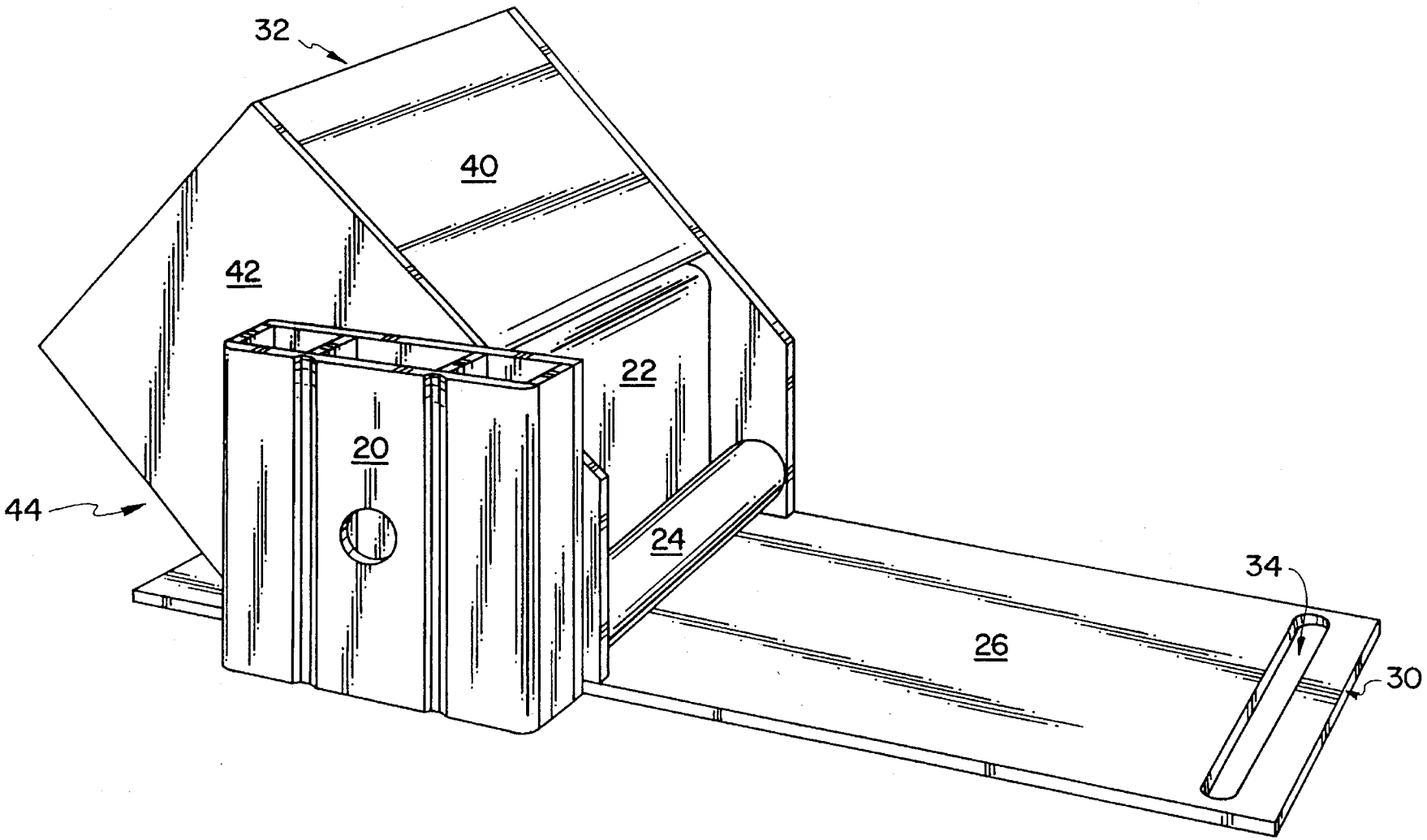
FIG. 1 is a perspective view of a paper roll note taking device in accordance with the invention.

A paper dispensing, note taking device in accordance with the present invention is shown in FIG. 1. The illustrated embodiment includes a note paper supply compartment 32 and a base 26 for providing a note taking surface, a slot 34 and sharp edge 30 for facilitating note detachment, and means for mounting the device to a horizontal or vertical support surface.

The support base is generally rectangular having a cutting edge 30 provided at or adjacent one longitudinal end. Adjacent to but spaced from that cutting edge is a paper receiving slot 34 for positioning and holding dispensed paper to facilitate note taking and removal of the segment of paper. It is to be appreciated that while in the illustrated embodiment, the paper receiving and centering component is in the form of a slot 34 defined through the base 26, other structures such as a paper receiving bracket on the face of the base 26 could be provided as an alternative. A slot 34, however, is the most practical and preferred embodiment at the present time. Furthermore, while the cutting edge 30 in accordance with the illustrated embodiment is the end edge of the holder, it is to be understood that the cutting surface 30 could likewise be provided by a component mounted to the support base structure 26 and having a sharp or cutting edge.

In the illustrated embodiment the paper supply compartment 32 is a box-like housing having side walls disposed generally perpendicularly with respect to the support base, an inclined front wall interconnecting the side walls 42, and an inclined rear wall 44 that is preferably but not necessarily parallel to the front wall 40. While in the illustrated embodiment continuous walls are illustrated as defining the paper supply housing 32, it is to be appreciated that other wall and housing defining structures or means, such as slats, rods, partial plates, etc. could be provided in the alternative, the primary function of the walls being to receive and retain the paper dispensing roll 36, as will become more apparent below.

In accordance with one embodiment of the invention, to provide tension for controlling dispensing of the note paper, a triangular formation 22, which may be a block; of generally triangular cross-section is disposed within the paper supply housing 32. The inclined face of the triangular formation 22 and the front inclined wall 40 of the paper supply housing 32 together define a trough or seat 41 into which the paper supply roll 36 is urged by gravity when the device is mounted vertically. (See FIGS. 5 and 7). Because the paper supply roll 36 will be urged against the walls of that trough 41 irrespective of the amount of paper remaining on the roll 36, free rolling of the paper roll 36 is precluded and the paper is tensioned to control dispensing.

Similarly, when the paper dispensing device is disposed on a horizontal surface, such as a table top, a trough or seat 43 is defined by the rear wall 44 of the housing 32 and the inclined face of the formation 22. (See FIG. 5). Again, the wedging of the paper roll into the trough 43 defined by the rear wall 44 and the triangular formation 22 tensions the paper being dispensed. In the illustrated embodiment, the front 40 and rear 44 walls are parallel and define with the inclined face of the formation 22 an angle of about 90°. However, the angle defined thereby could be greater, for example up to about 120° or smaller or for example as small as about 45°, being limited only by the fact that the roll 36 must not roll out of the housing in either the vertical or horizontal position and that the compartment must be able to receive a full size roll 36.

In the illustrated embodiment, the paper tension is further controlled by a rod 24 mounted to extend between the side walls 42 of the paper supply housing. The rod is preferably mounted to rotate relative to the side walls 42 so as not to overly resist dispensing of the paper.

Figure 4:
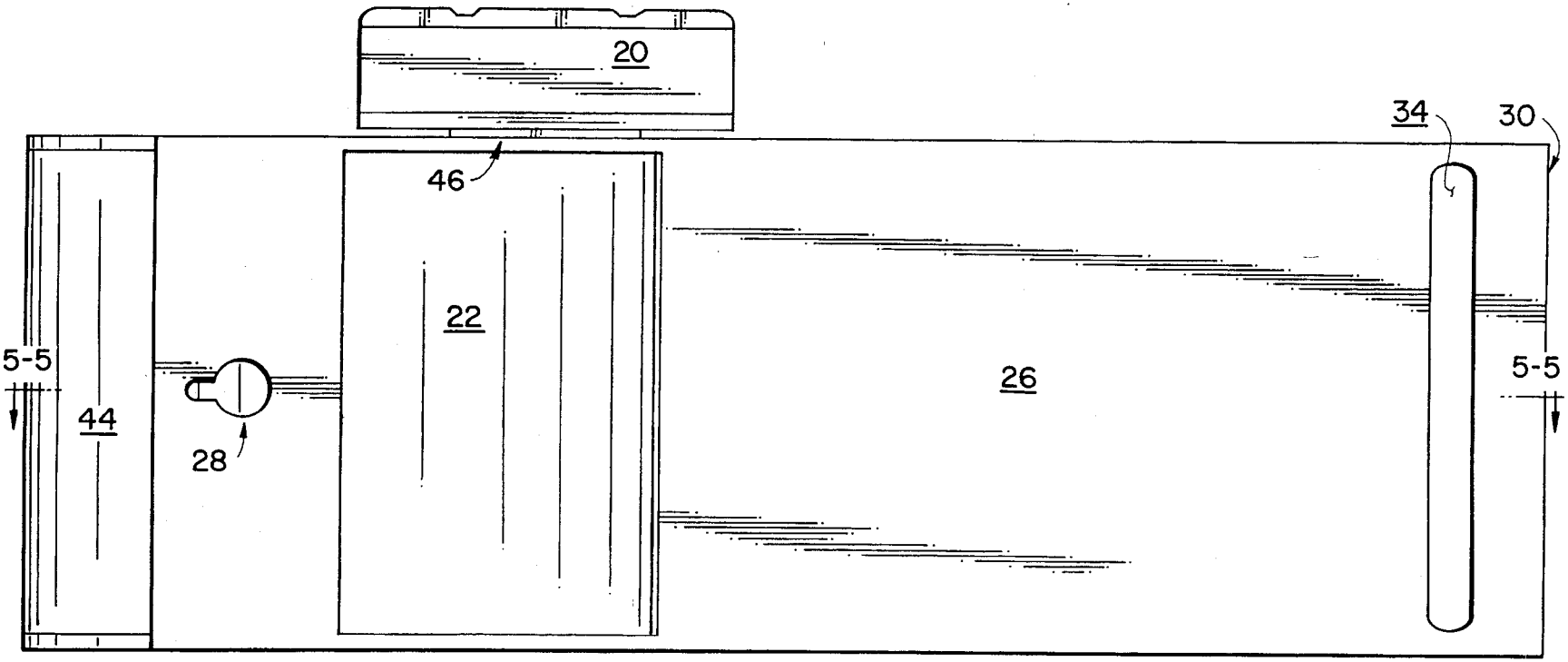
FIG. 4 is a bottom plan view of one embodiment of the invention.

As noted above, the paper dispenser of the invention may be mounted to a wall, for example adjacent to a wall telephone, or may be set on a table or desk top. To facilitate mounting to a vertical wall, a key hole aperture 28 as shown in FIG. 4 is defined through the base 26 so that the device can be mounted to a hook or large headed screw previously provided on the wall. It is to be understood, however, that other mounting accessories such as velcro, pin and socket, multiple hooks, screws and plastic anchors or the like could be provided as necessary or desirable. Furthermore where the note dispenser is intended solely for table top use, no mounting structure or aperture(s) need be provided. As a further alternative, non-skid pads or feet may be provided on the back or bottom surface of the base 26, particularly if the device is provided for desk top use.

In accordance with a second and currently most preferred embodiment of the invention, rather than providing a triangular block within the paper dispensing housing 32, as described above, the triangular formation 22 is provided as a part of the base structure 26 by providing a triangular offset within the base 26 to define the inclined face which advantageously facilitates tensioning of the paper roll. It should be appreciated that while the separate triangular offset is preferably made of the same material as the rest of the base 26, the offset could be made of wood, metal, plastic, or any of a host of other materials. It should further be understood that the triangular offset may be molded along with the base 26; the two pieces then forming one single piece. Thus, block 22 can also be permanently fixed to box 32.

In accordance with the most preferred embodiment, a pencil/pen holder 20 is provided as a part of the note taking device so that a user can always have a pen or pencil handy to jot down a thought or take a message. In the illustrated embodiment, a multi-compartment holder 20 is provided. Furthermore, to augment the versatility of the inventive device, the pencil/pen holder 20 may be pivoted about its mounting 38 to the paper supply housing 32 so that it can be oriented vertically, with pencil openings extending in the direction of the base structure 26 when the dispenser is mounted to a wall, or pivoted so that the pencil receiving compartments are perpendicular to the base structure 26 when the base is mounted to a table top. Preferably, the side wall 42 that has the holder 20 attached to it incorporates a raised disc portion 46 which provides less surface area with which the holder 20 may interact and thereby makes rotation consistent and more readily maintained.

Figure 6:
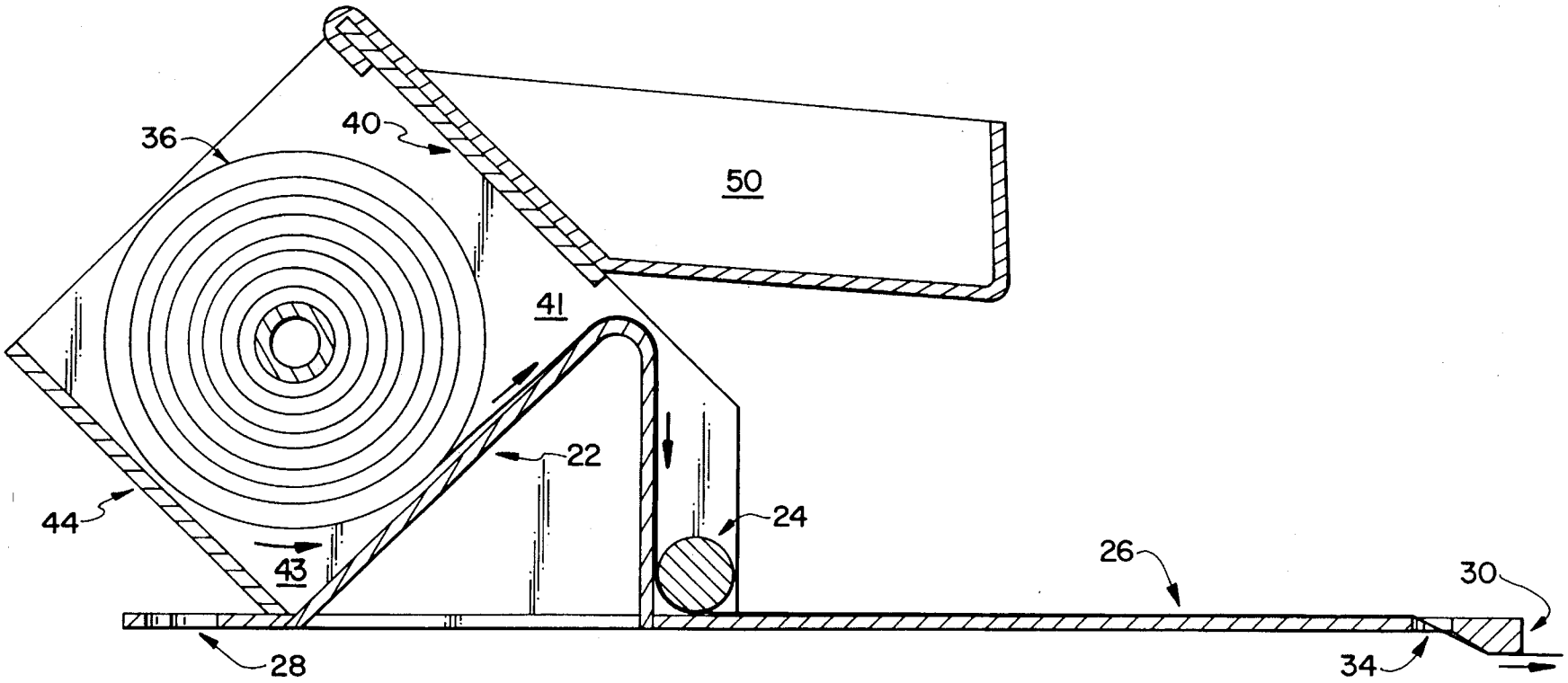
FIG. 6 is a cross-sectional view similar to FIG. 5 and further including a cross-sectional view of front mounted box 50.
Figure 7:
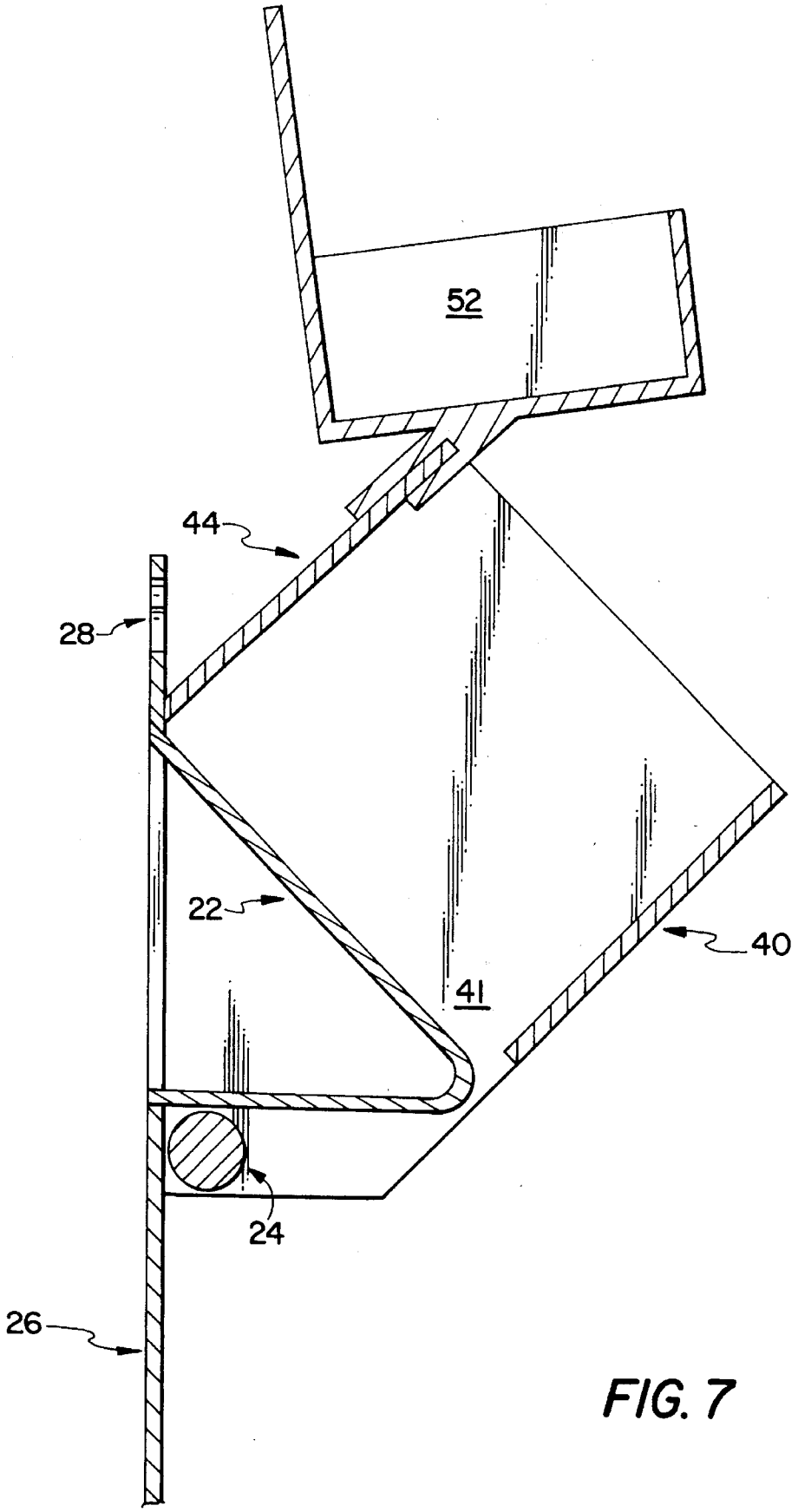
FIG. 7 is a cross-sectional view similar to FIG. 5 and further including a cross-sectional view of a rear mounted box.

In accordance with yet a further aspect of the invention a fast find card file box is secured to the paper roll note pad structure of the invention. More particularly, as shown in FIG. 6, a fast find card file box 50 may be attached to the front wall 40 when the paper dispensing device is disposed on a horizontal surface. In the alternative, if the device is mounted vertically a fast find card file box 52 may be attached to the rear wall 44, as shown in FIG. 7. In this manner, important telephone numbers and the like are readily available and blank cards are available to jot down new names and numbers to be incorporated in the fast find card file. It should be appreciated that both the front 50 and rear 52 trays may extend beyond either of the side walls 42, so long as the attachment slot is sized to engage the front or rear wall, respectively. It should further be appreciated that the front 50 and rear 52 boxes may alternatively contain items other than cards.

The manner in which the inventive device is preferably loaded and used will now be described. FIG. 1 is a perspective view of a device which embodies the principles of this invention.

Discussing now the drawing in detail, it will be seen that to insert paper roll it should be unwound slightly, and the ensuing strip of paper passed over the block 22 under rod 24, across the flat note taking surface 26, and down through slot 34. The paper strip is then capable of being pulled up and methodically ripped across edge 30. The remaining paper roll 36 is then placed in paper roll holder 32. A pencil/pen holder 20 is mounted on the side. The front inclined wall 40 and side wall 42 are also clearly visible.

Figure 2:
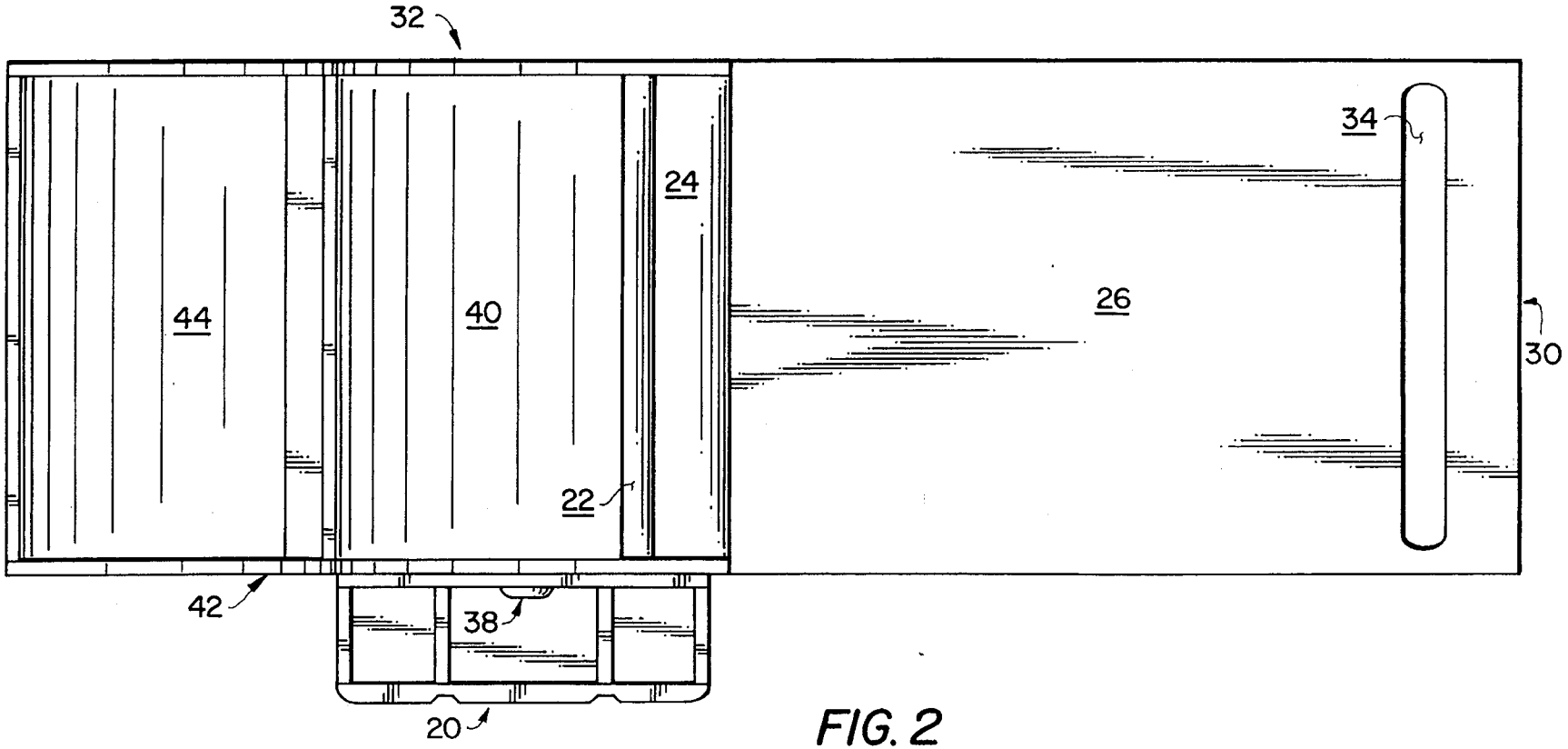
FIG. 2 is a top plan view thereof.

FIG. 2 is an overhead view and shows how the pencil/pen holder 20 is attached by retaining device 38 to paper roll holder 32. FIG. 2 also shows the rear inclined wall 44 and front inclined wall 40 of paper roll holder 32.

Figure 3:
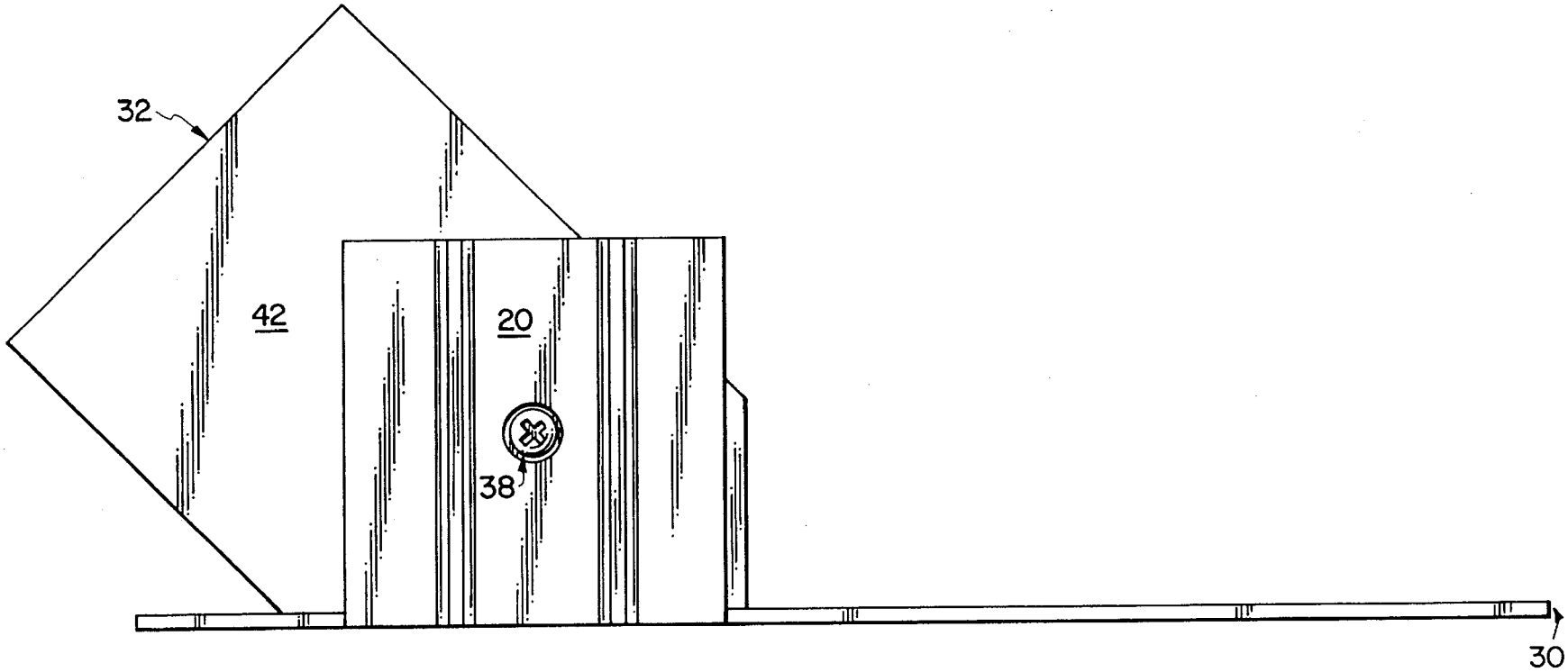
FIG. 3 is a side elevational view thereof.

Although pencil/pen holder 20 is oriented upwards in FIG. 3, retaining device 38 allows holder 20 to be rotated against a special integral friction surface.

A key hole 28 is depicted in FIG. 4 and allows the invention to be mounted onto a wall. The pencil/pen holder 20 can then be oriented upward.

Figure 5:
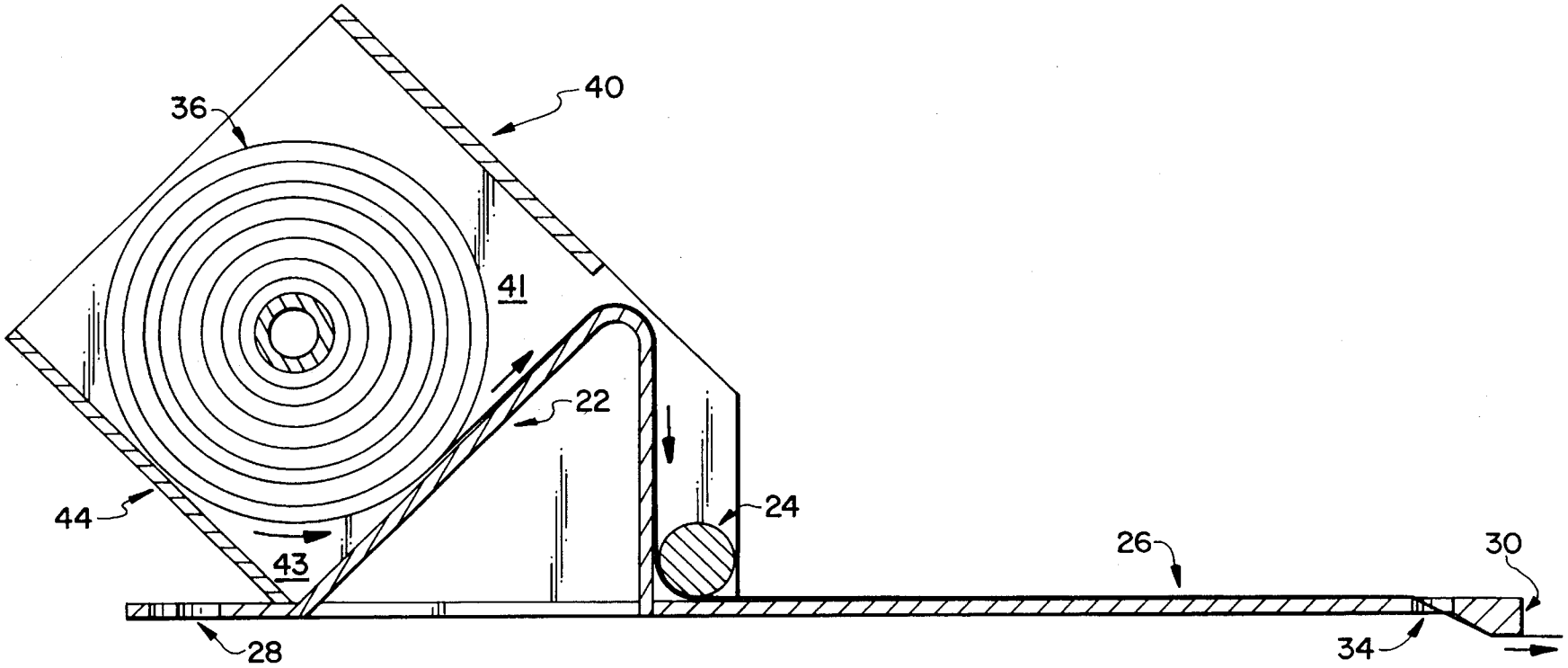
FIG. 5 is a cross-sectional view taken along line 5—5 of FIG. 4.

FIG. 5 shows the paper roll 36 and its paper strip as it feeds through the device from left to right in its preferred orientation. It should be appreciated that for the device to function best, the paper roll must be inserted into holder 32 for counter-clockwise rotation as shown.

While the present invention has been illustrated by means of several preferred embodiments, one of ordinary skill in the art will recognize that changes, modifications, and improvements can be made while still remaining within the scope and spirit of the present invention.

What is claimed is:

1. A roll paper device comprising:

a base plate having a longitudinal axis, first and second longitudinal ends, a substantially planar mounting side for being disposed generally flush against a planar mounting surface, and a paper dispensing side;

first and second side walls projecting from said paper dispensing side of said base plate;

a front wall extending substantially between said first and second side walls;

a rear wall extending substantially between said first and second side walls and said rear wall being inclined with respect to said base plate;

said first side wall, second side wall, front wall and rear wall defining a paper roll receiving compartment; and means defining an inclined face within said paper roll receiving compartment that extends substantially between said side walls and substantially between said front and rear walls, said inclined face defining with said front wall a paper outlet for paper dispensed from a paper roll within said compartment, said inclined face projecting from said paper dispensing side of said base plate;

said inclined face defining with said front wall a seat for a paper roll disposed within said compartment when said base plate is disposed in a vertical plane, mounted to a vertical mounting surface, said inclined face defining with said rear wall a seat for a paper roll disposed within said compartment when said base plate is disposed in a horizontal plane, on a horizontal mounting surface, whereby paper dispensed from the paper roll is tensioned irrespective of whether the base is vertically or horizontally disposed and irrespective of the amount of paper remaining thereon.

2. A paper dispenser as in claim 1, wherein said front wall, said rear wall and said inclined face are each substantially planar.

3. A paper dispenser as in claim 1, wherein said side walls are substantially perpendicular to said base plate.

4. A paper dispenser as in claim 1, wherein said inclined face defines an angle of about 90° with said front wall.

5. A paper dispenser as in claim 1, wherein the angle between said inclined face and said rear wall is between 45° and 120°.

6. A paper dispenser as in claim 1, wherein the angle between said inclined face and said front wall is between 45° and 120°.

7. A paper dispenser as in claim 1, further comprising a transverse rod extending between said first and second side walls.

8. A paper dispenser as in claim 7, wherein said rod has a circular cross-section and is mounted for rotation about its longitudinal axis.

9. A paper dispenser as in claim 1, further comprising means for centering paper dispensed from said compartment with respect to said base plate.

10. A paper dispenser as in claim 9, wherein said means for centering paper comprises a slot defined in said base plate through which paper is fed.

11. A paper dispenser as in claim 1, further comprising means defining a cutting edge for severing paper dispensed from said compartment.

12. A paper dispenser as in claim 1, further comprising means defining a holder for writing implements mounted on one of said side walls.

13. A paper dispenser as in claim 12, wherein said holder is pivotally mounted.

14. A paper dispenser as in claim 1, further comprising a card file box detachably mounted to one of said front wall and said rear wall.

15. A roll paper device comprising:

a base plate having a longitudinal axis, first and second longitudinal ends, a substantially planar mounting side for being disposed generally flush against a planar mounting surface, and a paper dispensing side;

first and second side walls projecting from said paper dispensing side of said base plate;

a front wall extending substantially between said first and second side walls;

a rear wall extending substantially between said first and second side walls, said rear wall being inclined with respect to said base plate and projecting from said paper dispensing side of said base plate;

said first side wall, second side wall, front wall and rear wall defining a paper roll receiving compartment; and means defining an inclined face within said paper roll receiving compartment that extends substantially between said side walls and substantially between said front and rear walls, said inclined face defining with said front wall a paper outlet for paper dispensed from a paper roll within said compartment, said inclined face defining with said front wall a seat for a paper roll disposed within said compartment when said base plate is disposed in a vertical plane, mounted to a vertical mounting surface, said inclined face defining with said rear wall a seat for a paper roll disposed within said compartment when said base plate is disposed in a horizontal plane, on a horizontal mounting surface, whereby paper dispensed from the paper roll is tensioned irrespective of whether the base is vertically or horizontally disposed and irrespective of the amount of paper remaining thereon.

16. A paper dispenser as in claim 15, wherein said inclined face defines an angle of about 90° with said front wall.

17. A paper dispenser as in claim 15, wherein the angle between said inclined face and said rear wall is between 45° and 120°.

18. A paper dispenser as in claim 15, further comprising a transverse rod extending between said first and second side walls.

19. A paper dispenser as in claim 15, further comprising means for centering paper dispensed from said compartment with respect to said base plate.

20. A paper dispenser as in claim 15, further comprising means defining a cutting edge for severing paper dispensed from said compartment.

21. A paper dispenser as in claim 15, further comprising means defining a holder mounted on one of said side walls.

22. A paper dispenser as in claim 21, wherein said holder is pivotally mounted.

23. A paper dispenser as in claim 15, further comprising a card file box mounted to one of said front wall and said rear wall.

* * * * *